US008354969B2

(12) United States Patent
Lin et al.

(10) Patent No.: US 8,354,969 B2
(45) Date of Patent: Jan. 15, 2013

(54) POLARIZER AND WAVEGUIDE ANTENNA APPARATUS USING THE SAME

(75) Inventors: Chih Jung Lin, Hsinchu (TW); Hsiang Hao Sung, Hsinchu (TW)

(73) Assignee: Microelectronics Technology, Inc., Hsinchu (TW)

( * ) Notice: Subject to any disclaimer, the term of this patent is extended or adjusted under 35 U.S.C. 154(b) by 349 days.

(21) Appl. No.: 12/842,387

(22) Filed: Jul. 23, 2010

(65) Prior Publication Data

US 2011/0043422 A1 Feb. 24, 2011

(30) Foreign Application Priority Data

Aug. 19, 2009 (TW) ..... 98215263 U

(51) Int. Cl.
*H01Q 19/00* (2006.01)
*H01Q 13/00* (2006.01)

(52) U.S. Cl. ..... 343/756; 343/786; 333/21 A

(58) Field of Classification Search ..... 343/756, 343/772, 786; 333/21 A, 125, 126, 95, 95 A
See application file for complete search history.

(56) References Cited

U.S. PATENT DOCUMENTS 3,603,905 A * 9/1971 Schuttloffel ..... 333/241
5,305,001 A * 4/1994 Wong et al. ..... 343/786

* cited by examiner

*Primary Examiner* — Hoang V Nguyen
(74) *Attorney, Agent, or Firm* — WPAT, P.C.; Anthony King

(57) ABSTRACT

A polarizer includes a waveguide channel having a substantially square cross section and a septum disposed within the waveguide channel. The septum includes a stepped edge and two opposite stepped surfaces. The stepped surfaces are sectionally recessed toward each other along the direction pointing toward the interior of the waveguide channel, wherein the number of the steps of the stepped surface is greater than two, but smaller than the number of the steps of the stepped edge. In one embodiment, the square cross section may include a plurality of rounded corners and a plurality of edges extending correspondingly between the rounded corners, wherein the ratio of the radius of the rounded corner to the distance between two opposite edges is in a range of from 0.05 to 0.3.

8 Claims, 8 Drawing Sheets

POLARIZER AND WAVEGUIDE ANTENNA APPARATUS USING THE SAME

BACKGROUND OF THE INVENTION

1. Field of the Invention

The present invention relates to a waveguide antenna apparatus and a polarizer, and relates more particularly to a polarizer having a stepped septum and a waveguide antenna apparatus using the same.

2. Description of the Related Art

In a microwave antenna system, a polarizer is utilized to convert a linearly polarized magnetic field to a circularly polarized magnetic field, or vice versa. Generally, different types of polarizer can be used in a microwave antenna system, in which a septum polarizer is one of the most popular.

A septum polarizer includes a waveguide. The waveguide may have an internal channel, which may have a cross section with a circular shape or a square shape. The metal septum is inserted into the channel in a direction along the longitudinal axis of the waveguide, dividing the channel into two equal sub-channels. An electromagnetic wave may be decomposed, by the septum, into two equal orthogonal projections, respectively parallel and perpendicular to the septum. Usually, the size of the septum is determined by a central operating frequency or wavelength.

However, traditional polarizers have several drawbacks. First, the bandwidth of the operating frequency of traditional polarizers is narrow, not satisfying the requirements of industrial applicability. Second, the square cross section of a traditional polarizer may easily exhibit cavity resonance phenomenon, and such resonance phenomenon may occur near the in-band frequency, negatively affecting signal quality. Third, when the operating frequency is greater than the X-band frequency (10 GHz), traditional polarizers cannot ensure the proper signal isolation between ports.

Thus, traditional polarizers still have many drawbacks, and development of a new polarizer is needed.

SUMMARY OF THE INVENTION

The first embodiment of the present invention discloses a polarizer, which comprises a waveguide channel and a septum. The waveguide channel may include a substantially square cross section. The septum can be disposed within the waveguide channel, and may comprise a stepped edge and two opposite stepped surfaces. The two stepped surfaces may be sectionally recessed toward each other along a direction pointing toward the interior of the waveguide channel. The number of steps of the stepped surface is greater than two, but smaller than the number of steps of the stepped edge.

The second embodiment of the present invention discloses a polarizer, which comprises a waveguide channel and a septum disposed within the waveguide channel. The waveguide channel may include a substantially square cross section, wherein the cross section of the waveguide channel includes a plurality of rounded corners and a plurality of edges correspondingly extending between the rounded corners, wherein the ratio of the radius of the corner to the distance between two opposite edges is in a range of from 0.05 to 0.3. The septum may be configured for conversion between circularly polarized waves and linearly polarized waves.

One embodiment of the present invention proposes a waveguide antenna apparatus, which comprises a feed horn and the polarizer of the above-mentioned first embodiment coupled to the feed horn.

Another embodiment of the present invention proposes a waveguide antenna apparatus, which comprises a feed horn and the polarizer of the above-mentioned second embodiment coupled to the feed horn.

To better understand the above-described objectives, characteristics and advantages of the present invention, embodiments, with reference to the drawings, are provided for detailed explanations.

BRIEF DESCRIPTION OF THE DRAWINGS

The invention will be described according to the appended drawings in which.

DETAILED DESCRIPTION OF THE INVENTION

Figure 1:
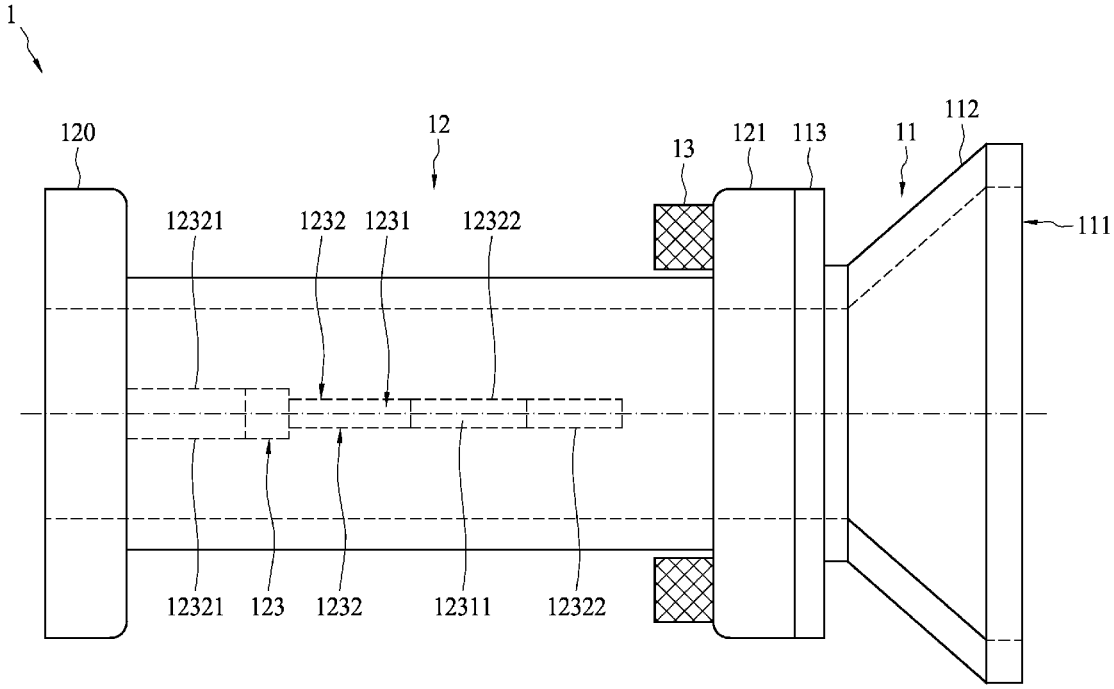
FIG. 1 is a side view showing a waveguide antenna apparatus according to one embodiment of the present invention.

FIG. 1 is a side view showing a waveguide antenna apparatus 1 according to one embodiment of the present invention. A waveguide antenna apparatus 1 of the present invention may comprise a feed horn 11 and a polarizer 12. The feed horn 11 comprises an aperture 111, a flared section 112, and a fixing portion 113. The aperture 111 is configured to face toward a dish antenna for guiding microwave energy in and out. The flared section 112 defines the aperture 111, connecting to the fixing portion 113. The polarizer 12 may have two end portions. Each end portion can be disposed with a fixed portion 120 or 121 so that the fixing portion 113 of the feed horn 11 can be fixed to the fixed portion 121 of the polarizer 12 using fasteners 13.

Figure 2:
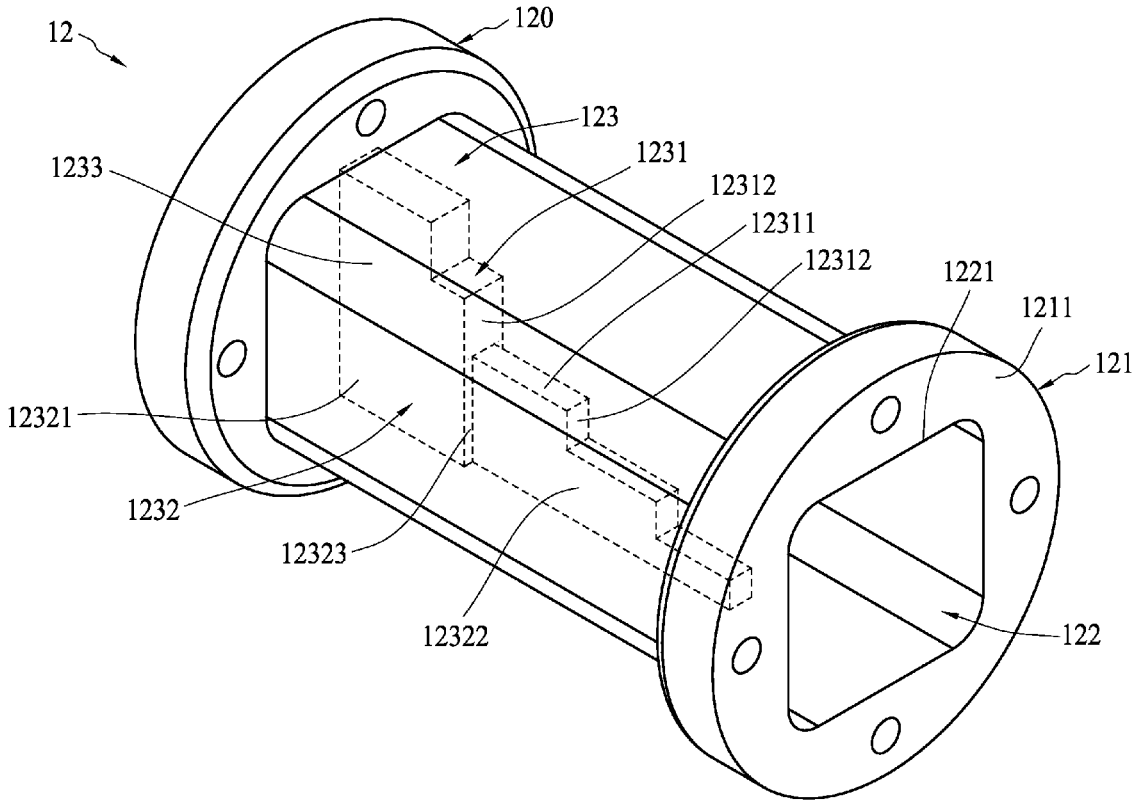
FIG. 2 is a perspective view showing a polarizer according to one embodiment of the present invention.

Referring to FIGS. 1 and 2, the polarizer 12 may comprise a waveguide channel 122 penetrating through the polarizer 12, forming two openings respectively on the end surfaces 1211 of the two fixed portions 120 and 121. The cross section of the waveguide channel 122 can be a square cross section with rounded corners. Although the rounded corner of the cross section of the waveguide channel 122 can have a large radius, the cross section still has a substantially square shape defined by straight edges. Within the waveguide channel 122, a septum 123 is disposed, as shown in FIG. 1. The septum 123 extends along the longitudinal direction of the waveguide channel 122, disposed at the transversely middle position of the waveguide channel 122. The septum 123 may include a stepped edge 1231, namely the septum 123 can be a stepped septum. One end portion 1233 of the septum 123 is disposed adjacent to the opening of the fixed portion 120. The height of the end portion 1233 is configured to match the spacing between two opposite inner edges 1221 of the waveguide channel 122 such that the end portion 1233 of the septum 123 can substantially equally divide the waveguide channel 122 into a right-hand circularly polarized (RHCP) port and a left-hand circularly polarized (LHCP) port. The remnant portion of the septum 123 extends into the interior of the waveguide channel 122 from the end portion 1233.

The septum 123 may include a stepped edge 1231 and an opposite edge extending along the inner wall surface of the waveguide channel 122. The stepped edge 1231 is sectionally recessed toward the opposite edge along the direction pointing toward the interior of the waveguide channel 122 so as to finally form a short end portion in the waveguide channel 122. In other words, the sectionally recessed stepped edge 1231 segments the septum 123 into a plurality of stepped sections with different heights. Each stepped section includes a stepped surface 12311 parallel to the inner wall surface of the waveguide channel 122, and adjacent stepped surfaces 12311 can be connected with a substantially nearly vertical rising surface 12312. In the present embodiment, the septum 123 can be segmented into 5 stepped sections.

Further referring to FIGS. 1 and 2, the septum 123 further comprises two stepped surfaces 1232 disposed on opposite sides of the septum 123 and respectively connecting to the stepped edge 1231, wherein the two stepped surfaces 1232 can be substantially symmetrical. The two stepped surfaces 1232 can be sectionally recessed toward each other along a direction pointing toward the interior of the waveguide channel 122 such that a plurality of stepped sections with different widths are obviously segmented. In the present embodiment, the septum 123 is merely recessed at the portion, from the middle to the end thereof, located in the waveguide channel 122 to form a stepped section with a smaller width so that the septum 123 can have two stepped sections 12321 and 12322. On the stepped surface 1232 between two stepped sections 12321 and 12322, there is a rising surface 12323 connecting the two stepped sections 12321 and 12322. In the present embodiment, each rising surface 12323 of the stepped surface 1232 may correspond to a rising surface 12312 of the stepped edge 1231, and preferably, the rising surface 12323 of the stepped surface 1232 and its corresponding rising surface 12312 of the stepped edge 1231 can be coplanar.

Figure 3:
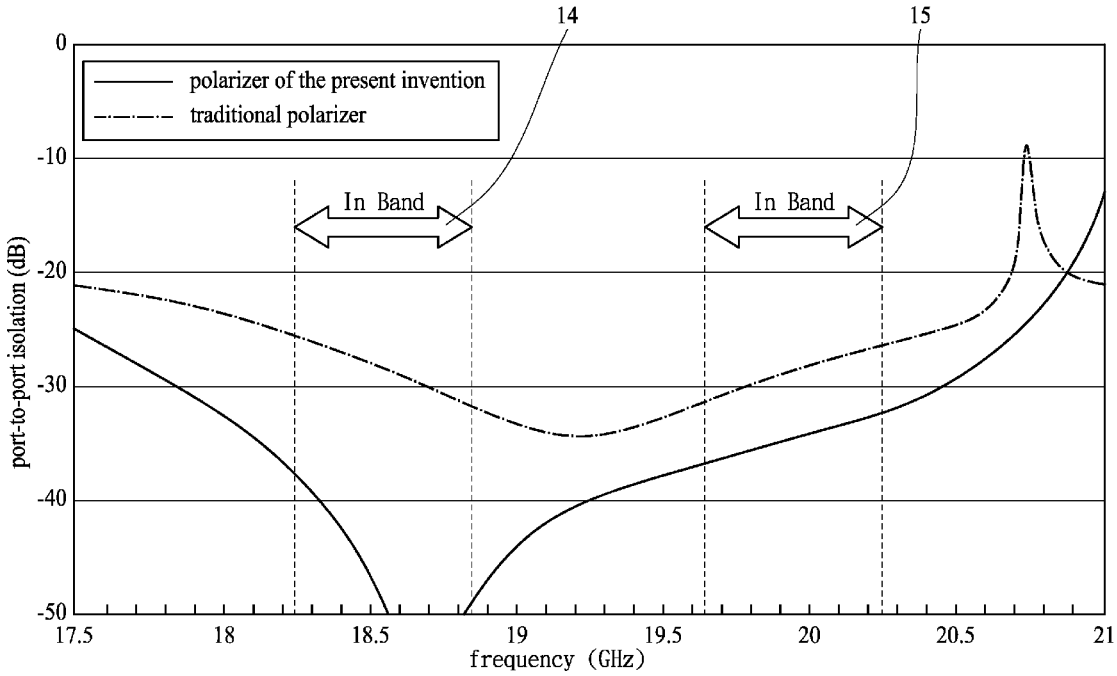
FIG. 3 is a diagram showing the simulation result of the port to port isolation of a polarizer of the present embodiment and a traditional polarizer according to one embodiment of the present invention.

FIG. 3 is a diagram showing the simulation result of the port to port isolation of a polarizer 12 according to one embodiment of the present invention. Referring to FIGS. 2 and 3, when traditional polarizers operate at high frequencies, the signal isolation between ports is usually not ensured. As shown in FIG. 3, for example, the isolation level of a traditional polarizer cannot exceed 30 dB over two application in-band frequency ranges 14 and 15. Comparatively, as shown by the dash-dot curve of FIG. 3, the isolation level of the polarizer 12 having a septum 123 with two stepped surfaces 1232 exceeds 30 dB over two application in-band frequency ranges 14 and 15, and particularly, exceeds 40 dB over the in-band frequency range 14. Therefore, the polarizer 12 having a septum 123 with two stepped surfaces 1232 can have improved port-to-port isolation.

Figure 4:
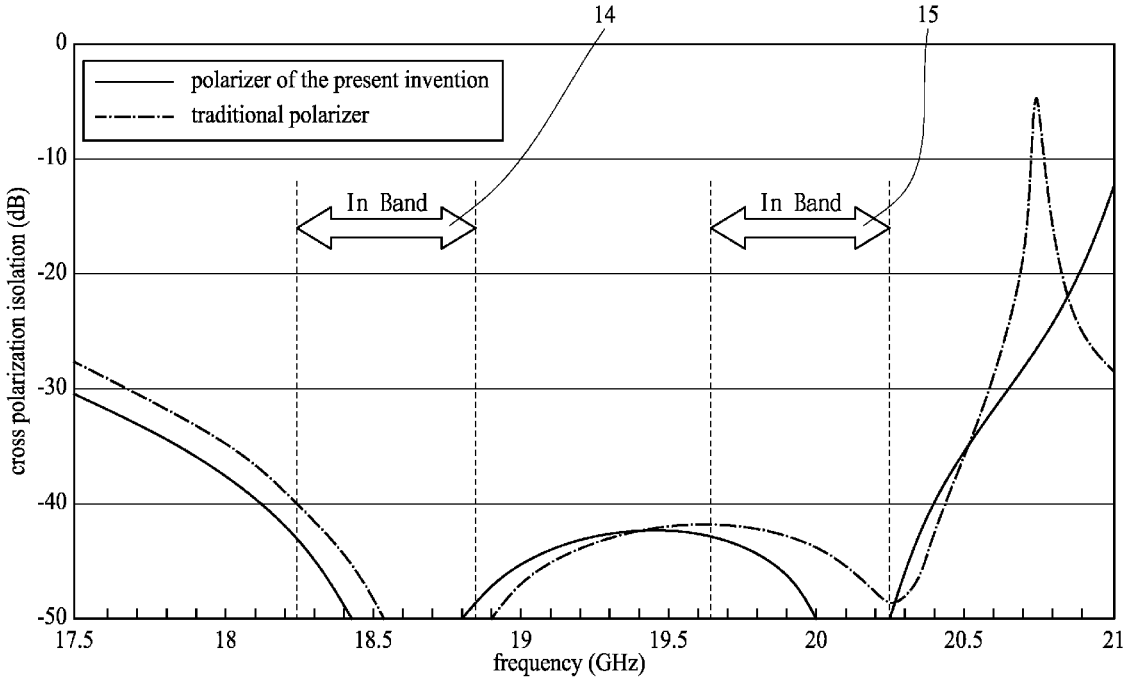
FIG. 4 is a diagram showing the simulation result of the cross polarization isolation of a polarizer of the present embodiment and a traditional polarizer according to one embodiment of the present invention.

Referring to FIGS. 2 and 4, over the two application in-band frequency ranges 14 and 15, the polarizer 12 (indicated by a solid curve) of the present invention provides significantly improved cross polarization isolation over a traditional polarizer (indicated by a dash-dot curve). Therefore, the polarizer 12 of the present invention can have improved cross polarization isolation.

Figure 5:
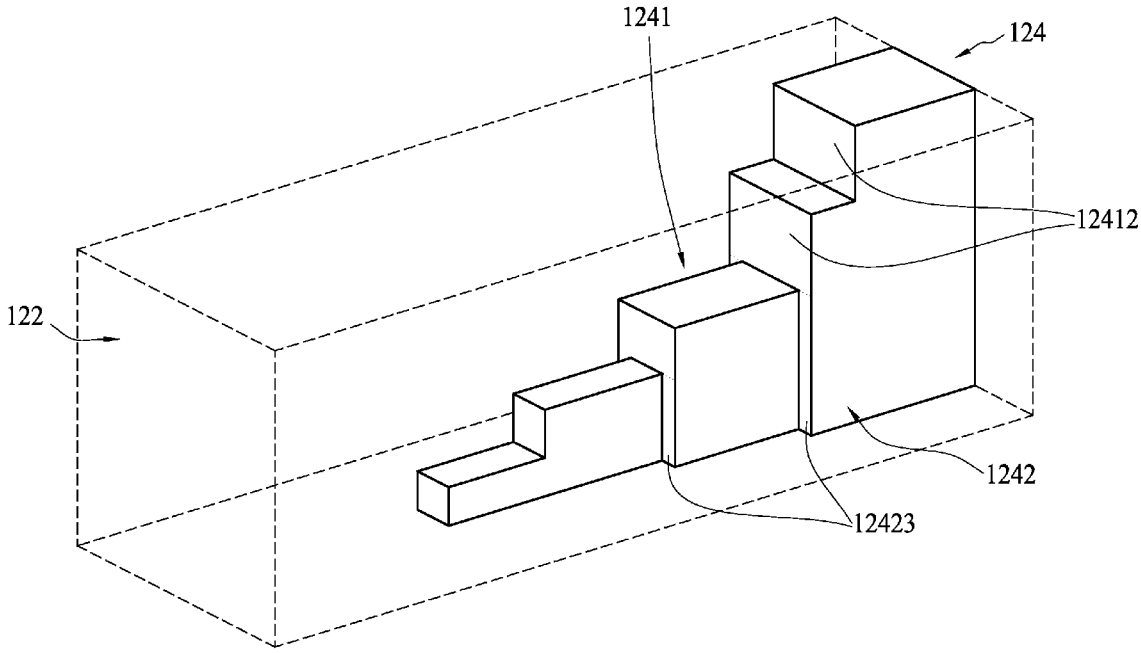
FIG. 5 is a perspective view showing a septum according to another embodiment of the present invention.

FIG. 5 is a perspective view showing a septum 124 according to another embodiment of the present invention. The septum 124 of the present embodiment comprises a stepped edge 1241 and two stepped surfaces 1242 respectively connecting to the stepped edge 1241. The height of the septum 124 is sectionally reduced in a direction toward the interior of the waveguide channel 122 so as to form the stepped edge 1241. The thickness of the septum 124 is sectionally reduced in a direction toward the interior of the waveguide channel 122, forming two recessed stepped surfaces 1242. In the present embodiment, there are five steps of the stepped edge 1241, and three steps of the stepped surface 1242. Further, the rising surfaces 12423 of the stepped surface 1242 may be disposed in accordance with the rising surfaces 12412 of the stepped edge 1241, and the corresponding rising surface 12423 and rising surface 12412 can be coplanar.

Figure 6:
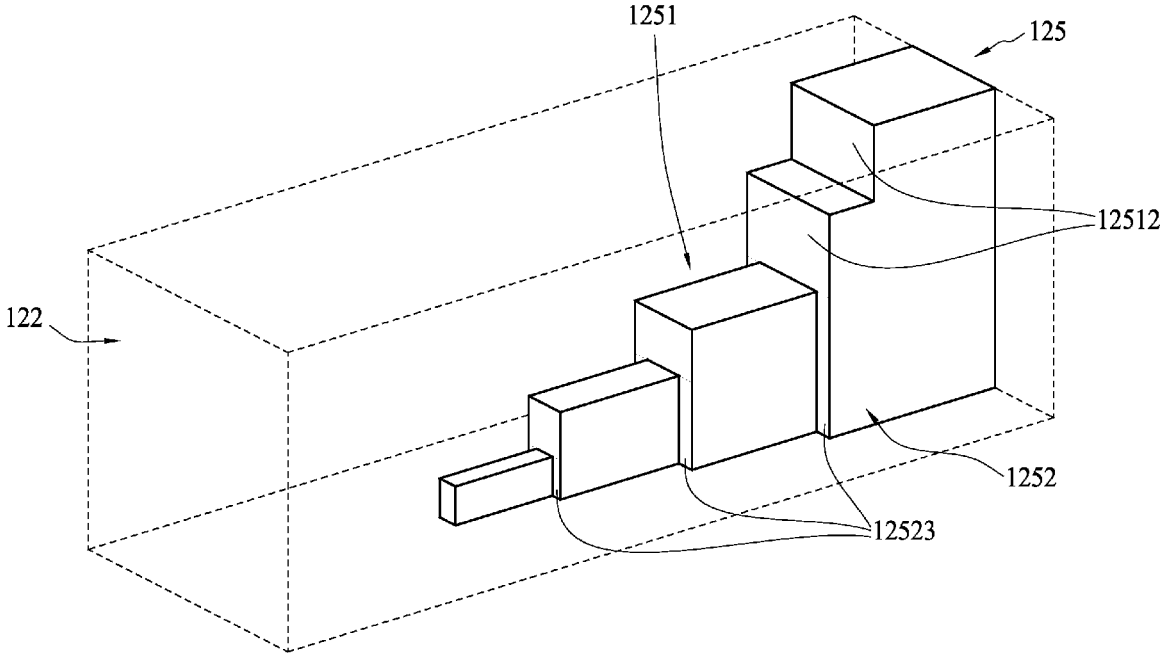
FIG. 6 is a perspective view showing a septum according to one embodiment of the present invention.

FIG. 6 is a perspective view showing a septum 125 according to one embodiment of the present invention. The septum 125 of the present invention comprises a stepped edge 1251 and two stepped surfaces 1252 respectively connecting to the stepped edge 1251. The height of the septum 125 is sectionally reduced in a direction toward the interior of the waveguide channel 122 so as to form the stepped edge 1251. The thickness of the septum 125 is sectionally reduced in a direction toward the interior of the waveguide channel 122, forming three recessed stepped surfaces 1252. In the present embodiment, there are five steps of the stepped edge 1251, and three steps of the stepped surface 1252. In addition, the rising surfaces 12523 of the stepped surface 1252 may be disposed in accordance with the rising surfaces 12512 of the stepped edge 1251, and the corresponding rising surface 12523 and rising surface 12512 can be coplanar.

In short, the polarizer of the present invention may include a septum. The septum may be a stepped septum with a stepped edge. The two side surfaces of the septum may be two substantially symmetrical stepped surfaces, wherein the number of the steps of the stepped surface is greater than 2 but less than the number of the steps of the stepped edge. Because the polarizer is disposed with a septum with stepped surfaces, it can provide improved port-to-port isolation and cross polarization isolation. Further, because the number of steps of the stepped surface is less than the number of the steps of the stepped edge, the configuration of the septum is simple so that it can be easily manufactured and manufactured with high yield.

Figure 7:
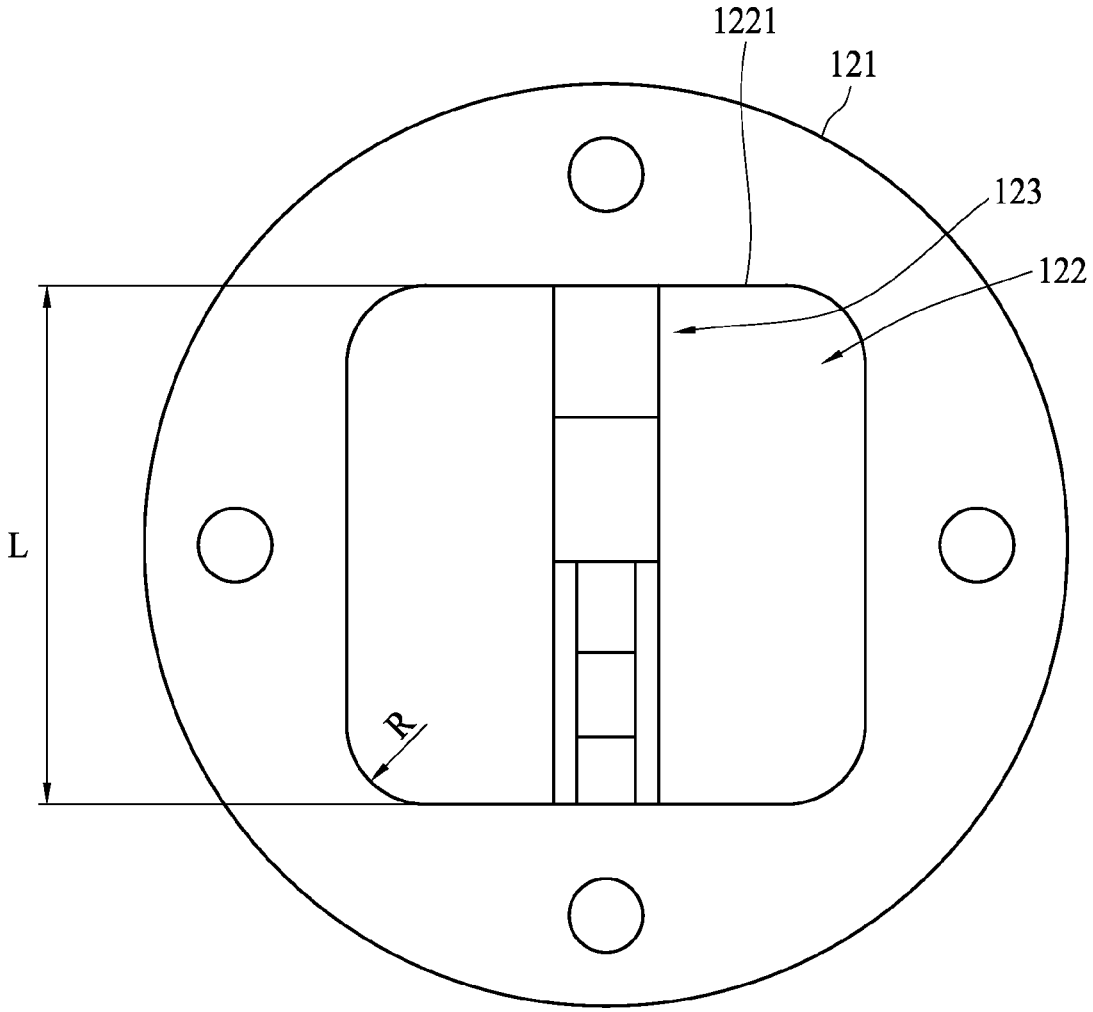
FIG. 7 is a front view showing the cross section of a waveguide channel according to one embodiment of the present invention.
Figure 8:
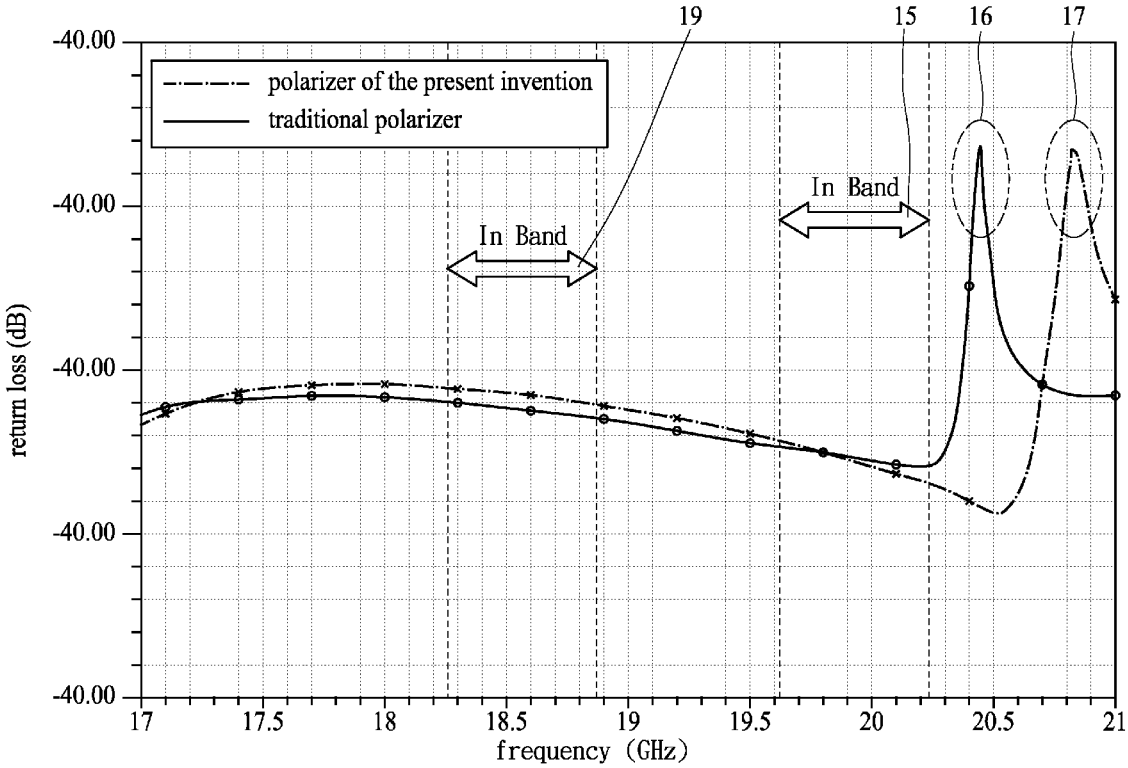
FIG. 8 is a diagram showing the simulation result demonstrating the return loss performance of the polarizer of the present invention and a traditional polarizer according to one embodiment of the present invention.

Referring to FIG. 7, the septum 123 of the present invention is mainly configured for a waveguide channel 122 with a square cross section. The cross section of the waveguide channel 122 is substantially square, having a plurality of rounded corners with radius of R and a plurality of edges 1221 correspondingly extending between the rounded corners, wherein two opposite edges 1221 are spaced apart by a distance of L, wherein the ratio of R to L can be in a range of from 0.05 to 0.3. Referring to FIG. 8, a traditional polarizer having a square cross section may easily have cavity resonance issues, and the cavity resonance may occur at frequencies near an application in-band frequency range, adversely affecting signal quality. When performing return loss measurements on a traditional polarizer, the measured cavity resonance frequencies 16 are near the application in-band frequency range 15 so that the return loss performance of the traditional polarizer is degraded. In contrast, the waveguide channel 122 with rounded corners may cause the measured cavity resonance frequencies 17 to move away from the application in-band frequency range 15, improving the return loss performance.

In summary, the polarizer of the present invention may include a stepped septum with a stepped edge. The two side surfaces of the septum may be two substantially symmetrical stepped surfaces, wherein the number of the steps of the stepped surface is greater than 2 but less than the number of the steps of the stepped edge. Because the polarizer includes a septum with stepped surfaces, it can provide improved port-to-port isolation and cross polarization isolation. Further, because the number of steps of the stepped surface is less than the number of the steps of the stepped edge, the configuration of the septum is simple so that it can be easily manufactured and manufactured with high yield. The septum is inserted into a waveguide channel with rounded corners so that the cavity resonance frequencies can be moved away from the application in-band frequency range.

The above-described embodiments of the present invention are intended to be illustrative only. Numerous alternative embodiments may be devised by persons skilled in the art without departing from the scope of the following claims.

What is claimed is:

1. A polarizer, comprising:

a waveguide channel including a substantially square cross section; and a septum disposed within the waveguide channel, the septum comprising a stepped edge and two opposite stepped surfaces, the two stepped surfaces sectionally recessed toward each other along a direction pointing toward the interior of the waveguide channel, wherein the number of steps of the stepped surface is greater than two, but smaller than the number of steps of the stepped edge.

2. The polarizer of claim 1, wherein the cross section of the waveguide channel includes a plurality of rounded corners and a plurality of edges correspondingly extending between the rounded corners, wherein the ratio of the radius of the corner to the distance between two opposite edges is in a range of from 0.05 to 0.3.

3. The polarizer of claim 2, wherein the radius of the corner is approximately 1.5 millimeters.

4. The polarizer of claim 1, wherein a step riser of the stepped surface and a corresponding step riser of the stepped edge are coplanar.

5. A waveguide antenna apparatus, comprising:

a feed horn; and a polarizer coupled to the feed horn, the polarizer comprising:

a waveguide channel including a substantially square cross section; and a septum disposed within the waveguide channel, the septum comprising a stepped edge and two opposite stepped surfaces, the two stepped surfaces sectionally recessed toward each other along a direction pointing toward the interior of the waveguide channel, wherein the number of steps of the stepped surface is greater than two, but smaller than the number of steps of the stepped edge.

6. The waveguide antenna apparatus of claim 5, wherein the cross section of the waveguide channel includes a plurality of rounded corners and a plurality of edges correspondingly extending between the rounded corners, wherein the ratio of the radius of the corner to the distance between two opposite edges is in a range of from 0.05 to 0.3.

7. The waveguide antenna apparatus of claim 6, wherein the radius of the corner of the cross section is approximately 1.5 millimeters.

8. The waveguide antenna apparatus of claim 5, wherein a step riser of the stepped surface and a corresponding step riser of the stepped edge are coplanar.

* * * * *